US005420608A

United States Patent [19]

Choi et al.

[11] Patent Number: 5,420,608

[45] Date of Patent: * May 30, 1995

[54] FRAME BUFFER ORGANIZATION AND CONTROL FOR REAL-TIME IMAGE DECOMPRESSION

[75] Inventors: Sung M. Choi, White Plains, N.Y.; Leon Lumelsky, Stamford, Conn.; Alan W. Peevers, Peekskill, N.Y.; John L. Pittas, Bethel, Conn.

[73] Assignee: International Business Machines Corporation, Armonk, N.Y.

[ * ] Notice: The portion of the term of this patent subsequent to Nov. 9, 2010 has been disclaimed.

[21] Appl. No.: 187,823

[22] Filed: Jan. 27, 1994

Related U.S. Application Data

[63] Continuation of Ser. No. 733,944, Jul. 22, 1991, abandoned.

[51] Int. Cl.[6] ..... G09G 1/02

[52] U.S. Cl. ..... 345/186; 345/191; 345/201

[58] Field of Search ..... 345/186, 191, 187, 189, 345/188, 190; 358/13, 133, 160; 364/514; 395/164, 162; 365/189.01

[56] References Cited

U.S. PATENT DOCUMENTS

| | | | |
|---|---|---|---|
| 4,541,010 | 9/1985 | Alston | 358/44 |
| 4,559,535 | 12/1985 | Watkins et al. | 340/781 |
| 4,564,915 | 1/1986 | Evans et al. | 364/521 |
| 4,580,134 | 4/1986 | Campbell et al. | 340/703 |
| 4,591,842 | 5/1986 | Clarke, Jr. et al. . | |
| 4,797,729 | 1/1989 | Tsai | 358/13 |
| 4,821,119 | 4/1989 | Gharavi | 358/133 |
| 4,857,992 | 8/1989 | Richards | 358/13 |
| 4,893,114 | 1/1990 | Ishii . | |
| 4,970,663 | 11/1990 | Bedell et al. | 364/521 |
| 4,975,771 | 12/1990 | Kassatly | 358/146 |
| 5,068,650 | 11/1991 | Fernandez et al. | 340/799 |
| 5,125,048 | 6/1992 | Virtue et al. | 358/160 |
| 5,138,308 | 8/1992 | Ropel | 340/703 |
| 5,163,024 | 11/1992 | Heilveil et al. | 340/799 |
| 5,261,049 | 11/1993 | Lumelsky et al. | 345/186 |

FOREIGN PATENT DOCUMENTS

| | | |
|---|---|---|
| 0279229 | 8/1988 | European Pat. Off. . |
| 0410777A2 | 1/1991 | European Pat. Off. . |

OTHER PUBLICATIONS

Texas Instruments, TMS34070 Production Data Sheet, 1986.

*Primary Examiner*—Howard W. Britton
*Assistant Examiner*—Gin Goon
*Attorney, Agent, or Firm*—Perman & Green

[57] ABSTRACT

A display system is described which includes storage for receiving a compressed pixel image manifesting at least a pair of encoded colors and a bit MASK that defines which pixels of a pixel subset of the pixel image receive one of the colors. The system comprises a plurality of memory modules. The pixels in the subset are interleaved in the memory modules. A generator is provided for applying signals to cause data to be written into each of modules in parallel. Register means are provided for applying data manifesting the encoded colors to the modules. Control apparatus is responsive to the MASK bits for controlling the generator to write the encoded color data, in parallel and in a single memory cycle, into all pixel positions of the subset that are designated for the color(s) by MASK bit position values.

14 Claims, 7 Drawing Sheets

FIG. 1.

16 BIT MASK PATTERN

MASK HI WORD MASK LO WORD

| 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|

22

4 x 4 PIXEL MAP

| | | | |
|---|---|---|---|
| 0 | 1 | 2 | 3 |
| 4 | 5 | 6 | 7 |
| 8 | 9 | 10 | 11 |
| 12 | 13 | 14 | 15 |

20

FIG. 2.

COMPRESSED DATA

| | 31 24 | 23 0 |
|---|---|---|
| HI WORD | 11000000 | COLOR A |
| LO WORD | 00100000 | COLOR B |

4x4 PIXEL
AFTER DECOMPRESSION

| | | | |
|---|---|---|---|
| B | B | B | B |
| B | A | B | B |
| B | B | B | B |
| B | B | A | A |

24

FRAME BUFFER ORGANIZATION AND CONTROL FOR REAL-TIME IMAGE DECOMPRESSION

This is a continuation of copending application Ser. No. 07/733,944, filed on Jul. 22, 1991, now abandoned.

CROSS-REFERENCE TO A RELATED PATENT APPLICATION

This patent application is related to commonly assigned U.S. patent application Ser. No. 07/733,906, filed on even date herewith, entitled "Video RAM Architecture Incorporating Hardware Decompression", by L. Lumelsky and S. Choi.

FIELD OF THE INVENTION

This invention relates to high performance display systems, and more particularly, to a frame buffer for use in such a high performance display system wherein image decompression is accomplished in real time.

BACKGROUND OF THE INVENTION

Scientific visualization helps users better understand the large quantities of data with which they are dealing. These visualizations are typically computed on a large super computers and are sent to user workstations for viewing over a high speed network. One powerful technique for visualization is the use of motion to augment a user's understanding of the data. By creating animations which show various surfaces of the data being viewed and displaying them as a smooth motion sequence, more information about the data being studied can be conveyed.

As the user's display resolution increases, it is increasingly difficult to send enough data over the network to provide the smooth motion required. Even with a high bandwidth communication network, transmitting enough data for smooth motion (30 frames per second or higher) is difficult without the use of some form of compression and decompression. If each pixel is represented by 24 bits, such that each 8 bit byte represents a color, then it can be shown that the data throughput required to show motion is $T=3H_{res}V_{res}F_{ref}$ bytes per second, where T is throughput in bytes per second, $H_{res}$ is the horizontal resolution, or number of pixels per scanline, $V_{res}$ is the vertical resolution, or number of scanlines per frame, and $F_{ref}$ is the frame rate.

In order to support the high bandwidth for real-time motion video, it is necessary to have a very high bandwidth communication network. One such network is HPPI (High Performance Parallel Interface). HPPI is designed to support a maximum data rate of 100 million bytes per second with a 32-bit wide data bus. However, the bandwidth of even HPPI may not be enough for high resolution, real-time, smooth motion images. For example, in order to show a full scale image on a 2048×1536 high resolution display monitor using a 32 bit wide HPPI bus, the maximum frame rate achievable is, $$\begin{aligned} F_{ref} &= T_{hppi}/(3H_{res}V_{res}) \\ &= 100{,}000{,}000/(2 \times 2048 \times 1536) \\ &= 10.6 \text{ frames per second} \end{aligned}$$

where $T_{hppi}$ is the 100,000,000 bytes per second throughput on HPPI

With only 10.6 frames per second, any considerable motion of an object is rendered jerky. One way to achieve smoother motion is to use a communication network with an even higher bandwidth. However, such a high bandwidth communication network is expensive. It may not justify the cost/performance ratio for most users. An alternate way of achieving real-time motion image communication is incorporating an image compression/decompression technique.

An advantage of using compression and decompression of images is that the storage required to record the image sequence at the source is reduced. A graphics server may generate a movie sequence, but store only the compressed image data. This allows the use of the super computer DASD (i.e. disk) storage as a digital video recorder of substantially more image frames than is possible otherwise. Another advantage of compression/decompression is that the bandwidth required to transfer images is reduced.

A favored compression algorithm is the block truncation method that is described in detail by Healy et al. in "Digital Video Bandwidth Compression Using Truncation Coding", IEEE Trans. Comm., COM-9, Dec. 1981, pp. 1809–1823. It provides high quality text and graphic image decompression and reasonable quality television-like natural images. The compression method itself is not directly relevant to this invention and only certain aspects of it will be reviewed.

The basic idea of the algorithm is to represent each 4 by 4 region of pixels (48 bytes, assuming 3 bytes per pixel) by two colors (6 bytes) plus a 16-bit wide MASK. The two colors are calculated statistically to best represent the distribution of colors in the 4×4 pixel region. The two colors are called HI color and LO color. Each MASK bit determines whether the corresponding pixel should get either a HI or LO color. When the MASK is '1', then the corresponding pixel gets the HI color; and when it is '0'then the corresponding pixel gets the LO color. This is illustrated in FIG. 1, which shows the bit mapping of a 4×4 pixel region 20 to its MASK 22. Since 4×4 pixels can be represented by using HI and LO colors (3 bytes each) and a 16 bit MASK (2 bytes), the compression ratio is $R_{cmp}=48/(3+3+2)=6$.

The decompression mechanism is simpler than that of compression. For each 4×4 pixel matrix, a destination device receives two colors (HI and LO) and a 16 bit MASK. For each bit of the MASK, the corresponding pixel in the 4×4 pixel matrix gets either the HI color, if the MASK bit is '1'or the LO color if the MASK bit is '0'. FIG. 2 shows the compressed data format of an arbitrary 4×4 pixel area 24, where each pixel is either one of the two colors, A or B.

In a typical system, data received over the network is temporarily buffered into a FIFO store (first-in, first-out) until it is ready to be stored in a frame buffer. A preferred frame buffer is comprised of video random access memories (VRAM's). Such VRAM's are operated in the fast page mode where a memory cycle is typically 50 nS.

It is known that decompression can be done by storing the compressed data format into a frame buffer and then decompressing the pixel data at the time of video refresh. Another method is to decompress an image prior to storing it into the frame buffer. Although the first method requires less frame buffer memory than the second, it presents problems because the compressed pixel data format cannot easily be used for data manipulation and almost any such operation requires the pixel data to be decompressed first. Also, if the frame buffer stores only a compressed data format, then another frame buffer is needed to store uncompressed images. The solution is to decompress the data prior to storing it into the frame buffer, such that the frame buffer contains only a R, G, B pixel format.

There are a number of problems associated with decompression. The first is that the decompression must be done in real-time in order for the frame buffer not to be the bottleneck in the system. For example, for the HPPI bus, a transmission of 4×4 pixel compressed data takes nominally 80 nS. In order for the frame buffer not to be a bottleneck it must be able to perform the decompression in 80 nS per compressed data set. The decompression should be done in a cost-effective way, using parts that are available off-the-shelf.

A classical solution that improves a memory's bandwidth is to interleave the memory. There are two ways to interleave a memory. One is to access the interleaved memory in parallel such that, in one memory access time, there will be N operations for an N way interleaved memory. The second is to access interleaved memory in a time-serial overlapped manner, such that another memory access to a different module can be started 1/N memory cycle period later for an N-way interleaved memory.

In either case, the frame buffer should be designed such that the decompression bandwidth is greater than or equal to the communication network bandwidth so that the frame buffer is not the bottleneck of the system. In order to maximize the bandwidth, each memory module should have an independent data path and separate controls such that all modules can operate in parallel. Notice that as described before, in case of HPPI communication network, 16 pixels of information is transferred every 80 nS (16 pixels/50 nS=200 million pixels/seconds). If 50 nS bandwidth memory chips are used within the memory modules, then N must be at least 10 (10 pixels/50 nS=200 million pixels/second). If N is 16, then a maximum bandwidth of 320 million pixels per second can be achieved (16 pixels/50 nS). Although simple memory interleaving gives the best performance, it does not justify the complexity and cost of having multiple memory modules, each with its own separate data path and controls.

The second problem is that there must be access to the frame buffer from a local workstation. Furthermore, this access must be either in non-compressed mode or compressed mode. Non-compressed mode access is important if the decompressed data is used by the local workstation for image manipulation. The compressed mode access also allows an increase in performance of the local workstation.

The third problem is that for a high resolution monitor, the serial output of the VRAMs must be interleaved to provide the bandwidth necessary for that monitor. Since current VRAMs have serial output bandwidths of approximately 33 Mhz, a typical frame buffer design has serial output ports interleaved depending on the attached display. For example, for a monitor resolution of 1280×1024, the video bandwidth is 110 Mhz. Thus, four way VRAM serial output interleaving is sufficient for such resolution. However, for a monitor resolution of 2048×1536, the video bandwidth is 260 Mhz. This requires eight-way interleaving, since four way interleaving only gives 4×33 Mhz, or 132 Mhz, but 8 ways gives 264 Mhz. The frame buffer design and the decompression design should be able to provide flexible video output bandwidth such that the design is not limited to a monitor's resolution.

The prior art shows a variety of image compression/-decompression schemes.

In U.S. Pat. No. 4,857,992, issued Aug. 15, 1989, entitled "Image Display Apparatus and Method" to Richards there is described a hardware compression/-decompression mechanism in which an image is characterized by two sets of digital data. The first set of data is achieved by low-pass filtering the original image and then by sub-sampling of it. The second set of data is a delta pulse-code modulated set between the interpolated image of the first set and the original image. These two sets of data are compressed using run length coding techniques.

In U.S. Pat. No. 4,975,771, issued Dec. 4, 1990, entitled "Method And Apparatus For TV Broadcasting" to Kassatly there is described a method in which multiple channels of video can be broadcast on a single channel carrier by compressing the video data and then time-multiplexing as packets on the broadcast medium. Basically, this patent shows how a video signal carrier can be used more efficiently by transmitting multiple channel video on a single carrier.

In U.S. Pat. No. 4,970,663, issued Nov. 13, 1990 entitled "Method and Apparatus For Manipulating Digital Video Data" to Bedell et al. there is described a method for improving image quality by using a compression method in which 15 bit red, green, blue source image data is sub-sampled and then converted into 8-bit LUV luminance and chroma values. On a display, the LUV format data is expanded to a full resolution using a dithering technique.

In U.S. Pat. No. 4,797,729, issued Jan. 10, 1989 entitled "System Incorporating An Error Tolerant Picture Compression Algorithm" to Tsai, there is described a method of compression/decompression that is based on block truncation techniques. Decompression is accomplished serially through the use of multiplexers and registers. Both HI and LO color data are loaded into two registers, then the HI and LO data is chosen based on a bit MASK in pixel-serial order. The patent discloses the use of Y, I, Q color signal components and for the Y component, for instance, it requires 16 cycles to complete the decompression of a 4×4 set of pixels. Because of the serial nature of the decompression, its bandwidth is limited.

In U.S. Pat. No. 4,580,134, issued Apr. 1, 1986 entitled "Color Video System Using Data Compression and Decompression" to Campbell et al., there is described a system for encoding, transmitting, storing, and generating color images. This patent also uses block-truncation techniques wherein the compressed data blocks are stored into a block buffer memory. Then, the patent describes the use of "fast" serial decompression logic at the video output path. This system requires very sophisticated and expensive on-the-fly decoding circuitry to enable data transfer to a high performance graphics display. Furthermore, since the frame buffer only stores the compressed data format, it cannot be used to store non-compressed images. Since block truncation techniques employ a lossy compression/decompression method, a non-compressed mode is desirable when the quality of an image is the most important factor.

In U.S. Pat. No. 4,564,915, issued Jan. 14, 1986 entitled "YIQ Computer Graphics System" to Evans et al. there is described a computer graphics system that provides a color television raster scan video output. The architecture shown therein permits the frame buffer to be upgraded from a simple color map system to a RGB, full color resolution system but requires added memory storage.

In U.S. Pat. No. 4,541,010, issued Sep. 10, 1985 entitled "Electronic Imaging Camera" to Alston there is described an electronic camera utilizing a charge coupled device array as both an image sensing device and a buffer memory. A method is detailed in which a preview mode can be shown on a CRT monitor at a video rate without requiring another dedicated buffer.

An IBM Technical Disclosure Bulletin, August, 1985, pp. 958–959, to Asano describes an image compression/decompression scheme wherein image decompression occurs prior to storage in an image buffer. Subsequently, the stored image is mapped to an all-points-addressable memory for display in accordance with an accompanying command. Accordingly, it is an object of this invention to provide an improved display system which exhibits a frame buffer capable of real-time image decompression.

It is a further object of this invention to provide an improved display system wherein image decompression can be achieved on a real time basis for a high definition display image.

It is yet another object of this invention to provide an improved display system which is capable of employing off-the-shelf hardware, but yet exhibits substantially improved system performance characteristics.

SUMMARY OF THE INVENTION

A display system is described which includes storage for receiving a compressed pixel image manifesting at least a pair of encoded colors and a bit MASK that defines which pixels of a pixel subset of the pixel image receive one of the colors. The system comprises a plurality of memory modules. The pixels in the subset are interleaved in the memory modules. A generator is provided for applying signals to cause data to be written into each of modules in parallel. Register means are provided for applying data manifesting the encoded colors to the modules. Control apparatus is responsive to the MASK bits for controlling the generator to write the encoded color data, in parallel and in a single memory cycle, into all pixel positions of the subset that are designated for the color(s) by MASK bit position values.

DESCRIPTION OF THE DRAWINGS

FIG. 1 is a representation of a 4×4 pixel map and shows how its individual pixel positions thereof map into a 16 bit MASK pattern that is used to identify color allocations thereto.

FIG. 2 shows a compressed data format of an arbitrary 4×4 pixel area, where each pixel is assigned one of two encoded colors.

DETAILED DESCRIPTION OF INVENTION

Figure 3:
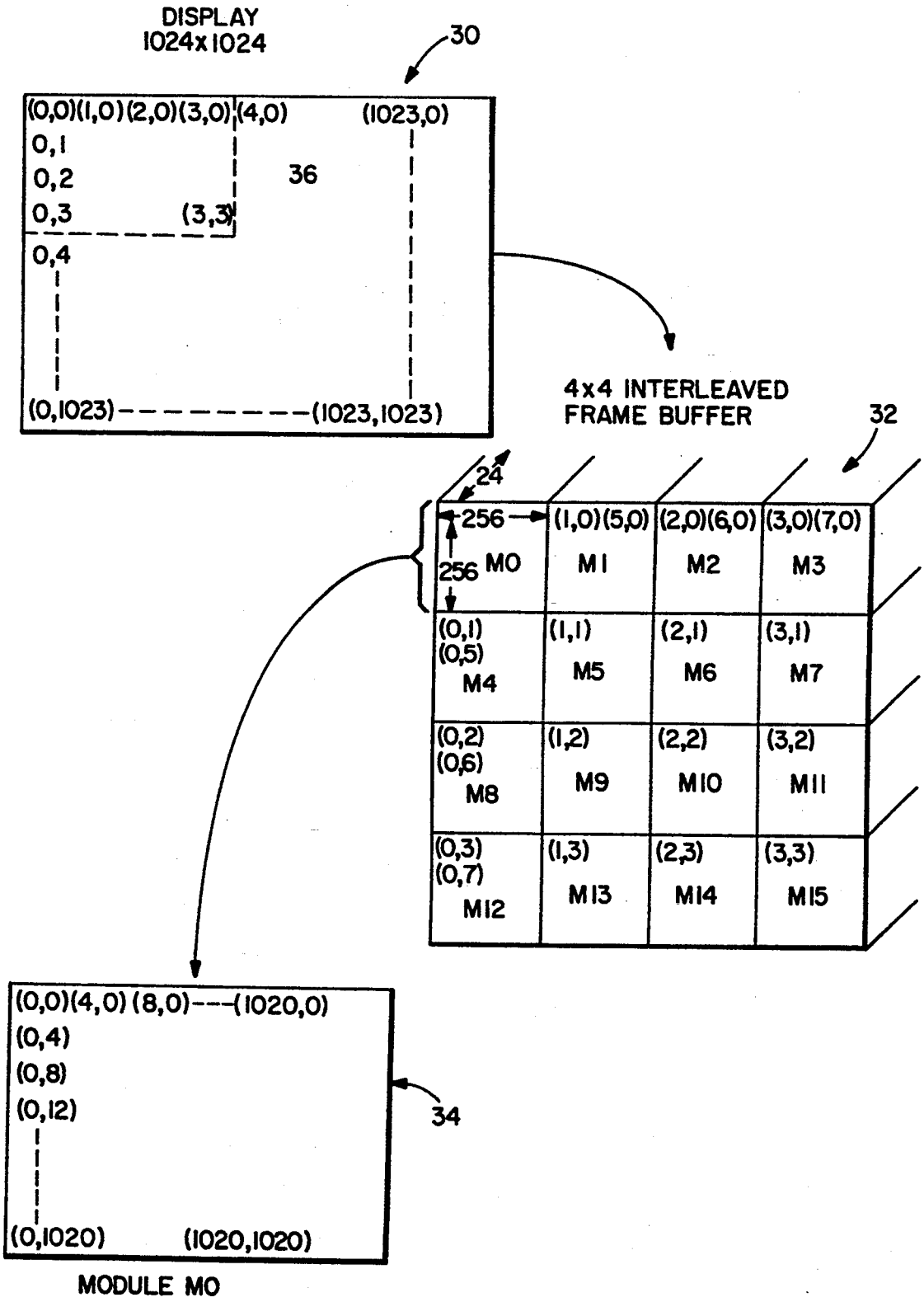
FIG. 3 is a schematic illustrating the relationship of the pixels on a display surface to memory positions in a 4×4 module frame buffer (and within one module thereof).

Referring now to FIG. 3, the interrelation between a display 30, a 16 memory module frame buffer 32 and an individual frame buffer module 34 will be hereinafter discussed. Display 32 is, for example, comprised of 1024×1024 pixels that are displayed in a raster manner. The expanded subsection 36 shows the upper left-hand corner of display 30 and comprises a 4 pixel×4 pixel subset and indicates the respective addresses of each of the pixels therein. Each pixel address has a column indication followed by a row indication with the upper left hand pixel having an address (0,0), followed by (1,0), (2,0) etc. on row 0. Each pixel is represented by 3 bytes (8 bits each) of color information.

A 4×4 interleaved frame buffer 32 is employed to store the pixel information from display 30 and comprises 16 memory modules M0–M15. Each memory module is 256×256×24 bit positions. The pixel addresses are interleaved into frame buffer 32 both vertically and horizontally, such that each pixel of a 4×4 pixel matrix resides in a different memory module. For example, for the 4×4 matrix 36 shown in display 30, address (0,0) resides in memory module M0; (1,0) in memory module M1, (2,0) in memory module M2, etc. Similarly, pixel address (0,1) resides in memory module M4; (0,2) in memory module M8, etc. At 34, a blow up of module M0 is shown indicating the pixel addresses stored therein. In the known manner, every fourth pixel address can be found therein (both rows and columns).

It can thus be seen, assuming 4×4 subsets of the pixel matrix are operated upon, that memory modules M0–M15 can be operated simultaneously to alter the state of pixel data stored therein. As will be hereinafter apparent, the interleaving shown in FIG. 3 enables, in combination with the incoming data format, real-time decompression to occur.

To reiterate, data is received in the format shown in FIG. 2 with compressed pixel data being received in two succeeding 32 bit words. A first word includes 24 bits (0:23) indicating a first color (A) and an 8 bit (24:31) HI word MASK. The next 32 bit word contains the succeeding color (color B) and an eight bit LO word MASK. Together, the LO and HI word masks map the two colors A and B onto the respective pixel map positions in a single decompression memory cycle. In the following description, it is assumed that frame buffer memory 32 is comprised of VRAM memory chips that employ row address strobe (RAS) signals and column address strobe (CAS) signals. As is known to those skilled in the art, those signals are active in the inverted state and will be indicated as such in this text when the signal designation is shown as RAS* or CAS*.

Figure 4:
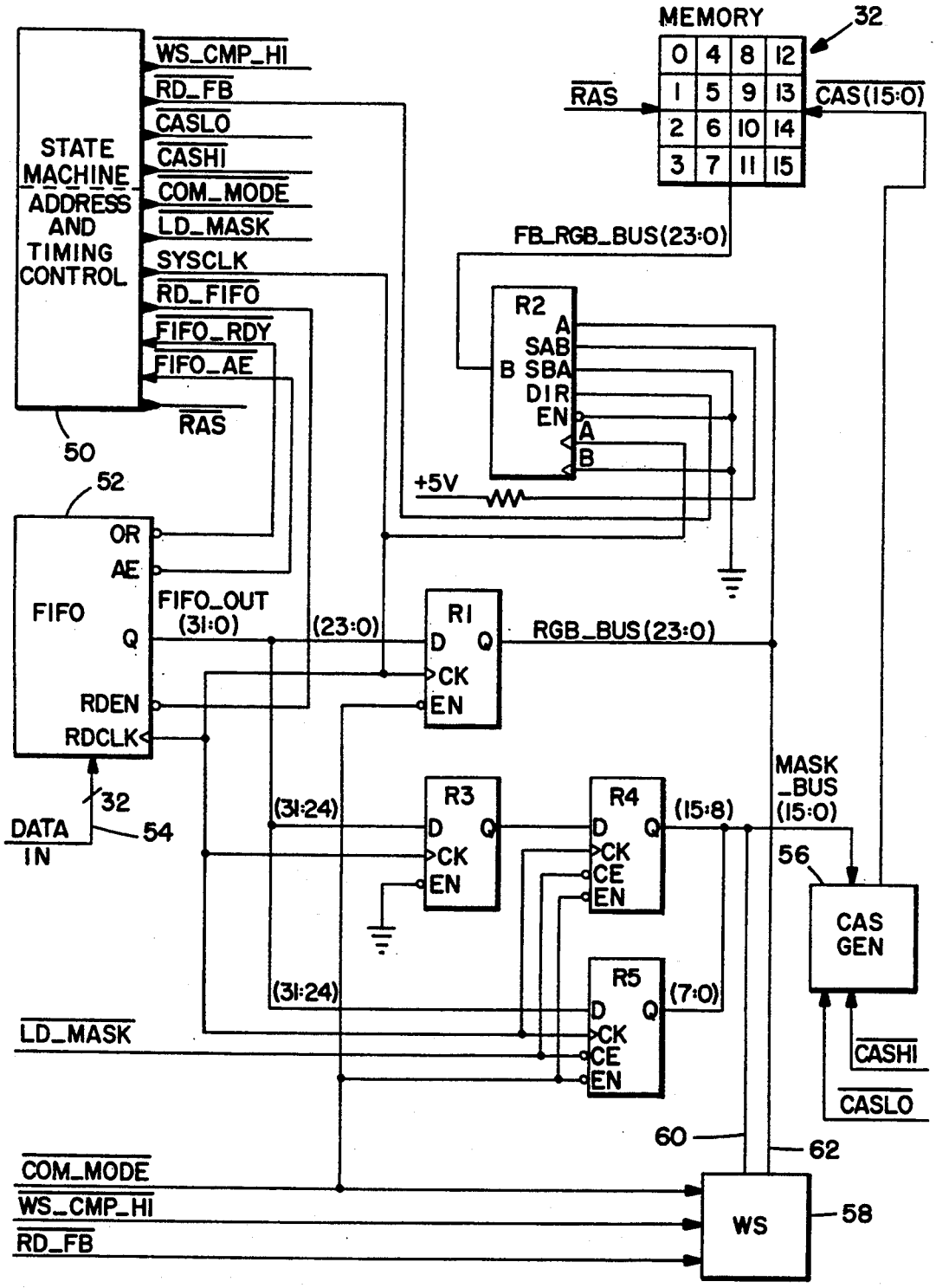
FIG. 4 is a block diagram showing the elements of an embodiment of the invention.

The frame buffer system shown in FIG. 4 comprises a state machine 50 which provides both address and timing control signals on its output lines. State machine 50 is essentially a sequencer that is organized by a central processor (not shown). The system further includes a FIFO store 52 which feeds into registers R1, R2, R3, R4 and R5. Compressed data is fed to FIFO 52 via data in cable 54. A CAS* generator 56 has applied thereto bit MASK portions from registers R4 and R5 and a pair of control signals CASH* and CASLO*. A workstation 58 is also interconnected with CAS* generator 56 and register R2 to enable a workstation 58 to also access frame buffer 32. Frame buffer 32 is organized as shown in FIG. 3 and comprises a 4×4 matrix of modules M0–M15.

Figure 5:
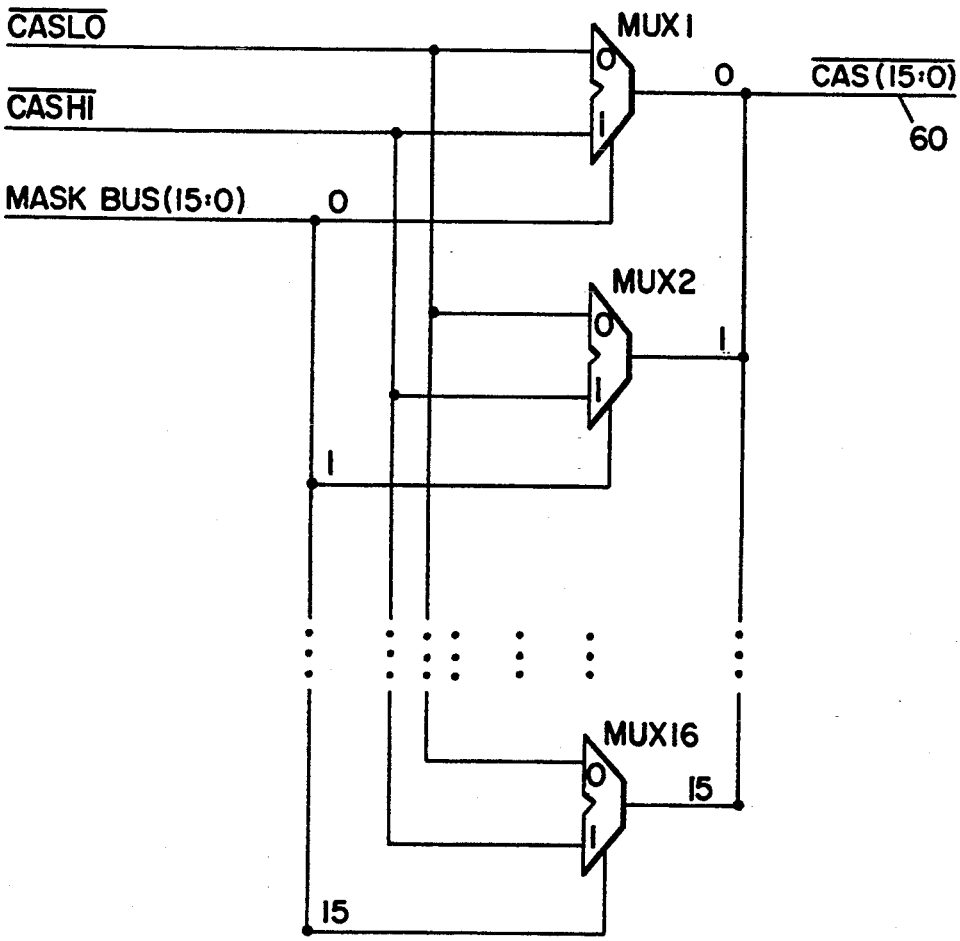
FIG. 5 is a block diagram of circuitry for generating CAS* signals in response to MASK and control inputs.

In FIG. 5, details of CAS* generator 56 are shown. Sixteen multiplexers (MUX1 through MUX16) receive CASLO* and CASHI* input levels. As will become apparent hereinafter, the CASLO* and CASHI* levels become active at different times in a single memory cycle. In addition, a bit level from the 16 bit MASK pattern is applied to each multiplexer as a controlling input and causes the respective multiplexer to provide an output upon the occurrence of the active state of one of its controlling inputs. If the MASK input is a 1, the respective MUX selects CASHI* and if the MASK input is a 0, the respective MUX selects CASLO*. Since CASLO* and CASHI* levels become active at different times in the cycle, 16 CAS* levels are produced on output cable 60 in a single memory cycle. Each CAS* level controls the writing of a color value into a respective pixel position of one of the 16 pixels within the 4×4 pixel matrix.

For the simplicity of description the HI color write will be described as preceding the LO color write for a given set of compressed data. This is not, however, a limitation of the invention, since either order can be used.

The method to be described hereafter for generating CAS* signals allows an 80 nS decompression cycle. The method reduces the time it takes to activate two CAS signals, CASHI* and CASLO*, where CASHI* is used to load the HI color and CASLO* is used to load the LO color. All HI colors of a compressed data set are stored into VRAMs using the same row and column addresses and are loaded during a CASHI* active time in a single memory cycle. When CASLO* becomes active later in the same memory cycle, all LO colors are loaded, thus enabling 16 pixel positions to be loaded with both colors in a single memory cycle.

Figure 6:
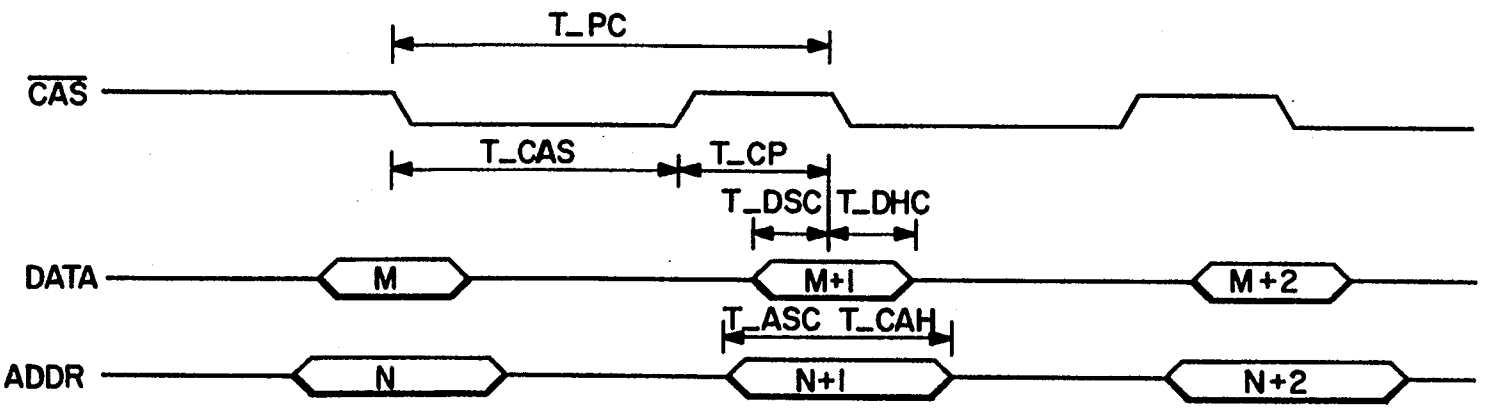
FIG. 6 is a waveform diagram illustrating the operation of a conventional VRAM.

FIG. 6 shows a typical timing diagram specified for a VRAM. The timing information is from a Mitsubishi, 1 Mbit VRAM part number M5M442256JL-8. This timing information determines the performance of the frame buffer.

* $t_{pc}$—Fast Page Mode Cycle Time. Minimum of 50 nS
* $t_{cas}$—CAS-Pulse Width. Minimum of 25 nS.
* $t_{cp}$—CAS-Precharge Time for Fast Page Mode. Minimum of 10 nS.
* $t_{dsc}$—Data Setup Time. Minimum of 0 nS.
* $t_{dhc}$—Data Hold Time. Minimum of 25 nS.
* $tas_c$—Column Address Setup Time. Minimum of 5 nS.
* $t_{cak}$—Column Address Hold Time. Minimum of 20 nS.

Figure 7:
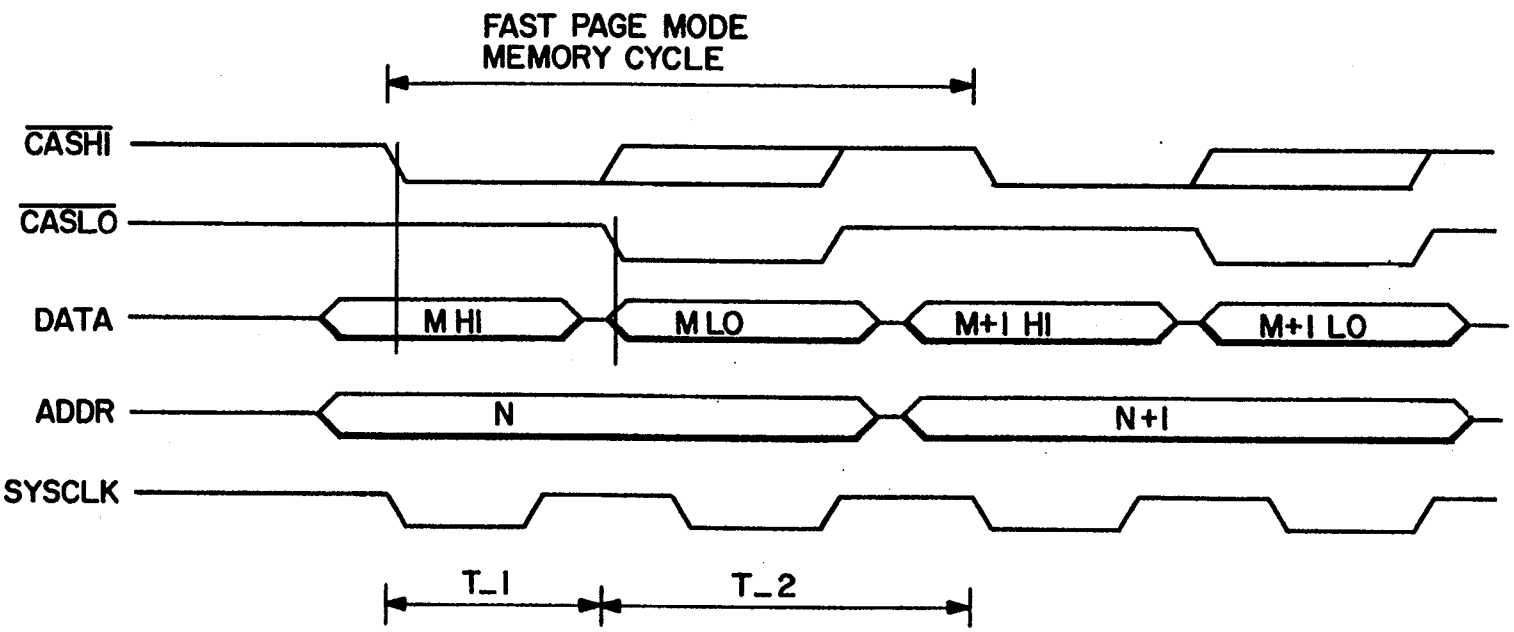
FIG. 7 illustrates the decompression memory cycle employed by the invention.

FIG. 7 shows the timing diagram of a fast compressed mode page mode cycle used by this invention. A less than 100 nS ($2t_{pc}$) cycle is achieved using a VRAM with $t_{pc}$ of 50 nS. As shown in the timing diagram, CASHI* and CASLO* signals can be overlapping. This is possible, since for a compressed mode memory cycle, only one CAS* is selected, whether it be CASHI* or CASLO*, but not both at the same time. M HI and M LO on the DATA Line indicate when the HI and LO colors are manifested by register R2 in a memory cycle. The minimum possible cycle time for decompression is, $T_{cmp}=t_1+t_2$, where $t_1$ is $t_{dhc}$ (Data hold time) and $t_2$ is $t_{pc}$ (Page Mode Cycle).

It should be noted that $t_1$ is necessary so that data hold time for the first color write cycle is not violated. Time $t_2$ is necessary due to the memory operation where a memory module has a LO color compressed mode followed by a HI color compressed mode. The separation between these two consecutive CAS* falling edges must be at least $t_{pc}$.

As indicated above, a Mitsubishi, 1 Mbit VRAM exhibits a $t_{dhc}=25$ nS and a $t_{pc}=50$ nS. Thus ideally, $t_{cmp}=75$ nS. With 75 nS decompression, HPPI compressed data can be received at full transfer rate. Since the time required for a decompression is reduced from 100 nS to 75 nS, the performance improvement due to the two CAS method is, $R_{2cas}=100/75=1.33$.

In order for the frame buffer not to be a network bottleneck, the relationship $T \geqq NP$ must hold true, where T is the throughput of the network, N is the number of 4×4 memory modules interleaved, and P is the performance of the frame buffer decompression for a 4×4 memory module. For HPPI, T=200 million pixels/second. If a two CAS* method is not used, then with a single 24 bit R, G, B data path, each decompression takes 100 nS with a 50 nS VRAM. This results in P=160 million pixels/second. Therefore, in order for the frame buffer not to be the bottleneck, N must be >=2. Another 4×4 memory module is needed which operates in parallel. Alternately, an expensive method of interleaving, where each memory module has its own separate data path and controls may be used. However, if a two CAS* method is used, then P =213 million pixels/second can be achieved. Therefore only one 4×4 memory module with only a single 24 bit R, G, B data path is needed.

Referring now back to FIG. 4 in conjunction with FIG. 7, the operation of the on-line decompression/-buffer system will be described. Succeeding 32 bit data words are fed via data input 54 into FIFO store 52. A free running system clock (SYSCLK) is generated by state machine 50 and controls the operation of FIFO 52 as well as synchronizing the remaining components of the system.

When enough data has been received in FIFO 52, the FIFO RDY* signal is activated to signify that there is data in FIFO 52 to be processed. State machine 50 recognizes that signal and enters the fast page memory access mode by activating communication mode signal COM MODE* and RD FIFO* until it aborts the fastpage memory mode access upon detecting FIFO almost empty (FIFO AE*). State machine 50 also generates a load MASK enable signal (LD MASK*) every second SYSCLK for the duration of RD FIFO*. Note that since the compressed data always comprises a pair of 32 bit words, the duration of RD FIFO* is always a multiple of two SYSCLKs.

24 bit color data (23:0) is read out of FIFO 52 and piped to registers R1 and R2. HI MASK bits (15:8) are also read out of FIFO 52 and are temporarily stored in register R3 for a clock period and are then loaded into register R4 on the same clock period when LO MASK bits (7:0) are loaded into register R5. The 16 MASK bits (15:0) are held in registers R4 and R5 while HI and LO color data bits are successively loaded into register R2 and are driven into memory modules 32.

Memory 32, as described above, is configured with 4×4 memory modules, with pixels interleaved therein in both the horizontal and vertical directions in a 4×4 pattern. CAS* generator 56, in a memory cycle, provides 16 CAS* signals whose levels are controlled by the color MASK. During the first portion of a decompression cycle (i.e. CASHI*), a 24 bit HI color is broadcast from register R2 to memory modules 32, and CAS* generator 56 generates active levels on those of its output lines that correspond to bit positions exhibiting a 1 level in the bit MASK. This enables the HI color data to be written in parallel into selected pixels corresponding to the high order MASK bit positions that are at the 1 level. On the second part of the decompression cycle (i.e. CASLO*), the LO color pixels are written under control of the 0 bits in the bit MASK, thus completing a decompression cycle.

The above operation is partially illustrated in FIG. 7 where, when CASHI* drops to the active state, 1 bits in the MASK cause CAS* signals to be applied to memory 32 so that the HI color bits emanating from register R2 are written to the 16 pixel memory positions. In a similar manner, when CASLO* drops to the active level, the LO color bits are written to the pixel positions corresponding to the 0 bits in the MASK.

Workstation 58 (see FIG. 4) also has access to buffer memory 32 via busses 60 and 62. Through appropriate imposition of MASK bits on bus 60 and color data on bus 62, the CASHI* and CASLO* signals can achieve the writing of the color data into memory modules 32, as above noted.

When a very high resolution frame buffer is desired, the video clock rate cannot be ignored. For example, a VRAM has a serial port which can be operated at 33 Mhz. But, for a 60 Hz, 2048×1536 resolution monitor, the video clock speed is in excess of 260 Mhz. It can be seen that (260 Mhz/33 Mhz)=7.88. In order to match the video clock, the VRMA must be interleaved a minimum of 8 ways to provide enough serial output bandwidth for the high resolution monitor. The design shown in FIG. 4 is modular and the video output bandwidth can be increased to 4P of a single VRAM serial output, where P is a positive integer which represents the number of 4×4 sets of memory modules being used. This allows the system's video throughput to be increased to match any resolution monitor. A 60 Hz, 2048×2048 resolution monitor requires a 360 Mhz video rate. Since (360/33)=10.9, then P=3 would provide enough video bandwidth.

Figure 8:
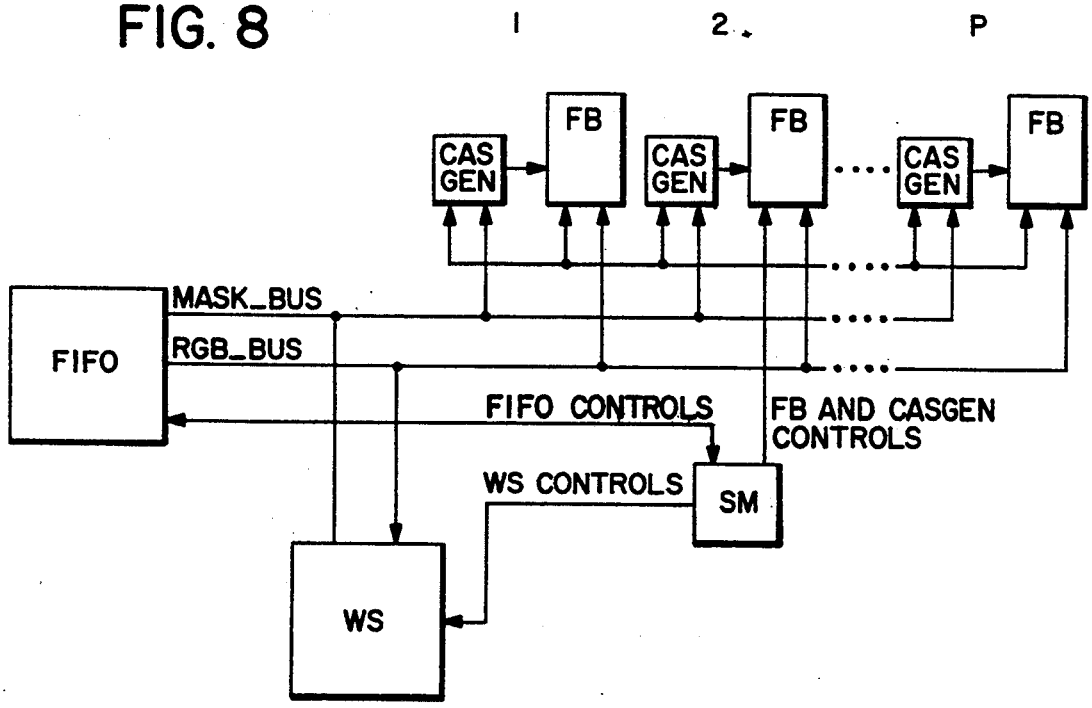
FIG. 8 is a block diagram of an embodiment of the invention enabling extended video-rate performance.

As shown in FIG. 8, this can be done by adding more 4×4 memory modules onto the main bus. A module consists of CASGEN* and a frame buffer (FB). The 4×4 memory elements themselves are interleaved. In other words, a first module will have pixels 0 through 3, a second module will have pixels 4 through 7, until a j-th module which will have pixels 4(j-1) through 4(j-1)+3. The controlling state machine (SM) must be modified in a way that it selects the correct CASGEN, and frame buffer when memory requests are made. Using this modular 4×4 approach, a video output throughput can be extended indefinitely to match any video rate for any monitor.

Figure 9:
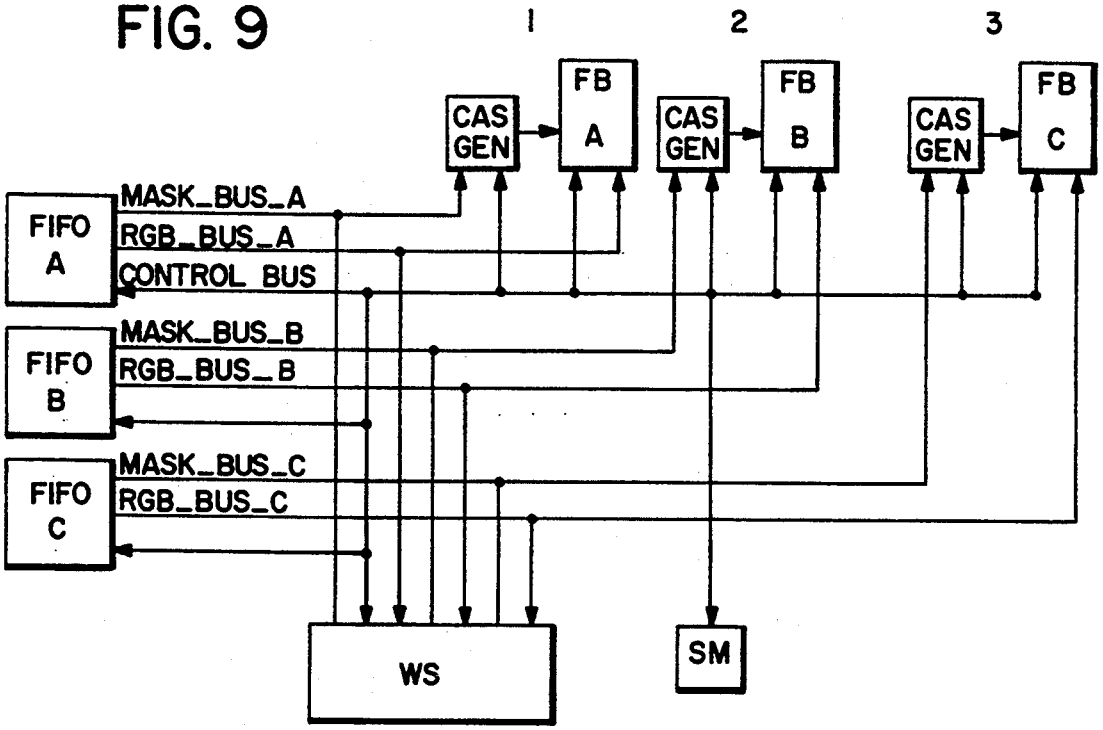
FIG. 9 is a block diagram of an embodiment of the invention enabling interfacing to higher bandwidth communication networks.

When the design requires interfacing to an even higher bandwidth communication network, it can be modified to accept higher throughputs from the network by parallelizing the input. This can be done by adding more FIFO's, CASGEN's, and FB's with a slight modification to the existing SM. FIG. 9 shows an example, where there are three sets of FIFO's, CASGEN's, and FB's. With this arrangement, there will be parallelization among three modules to increase the performance by a factor of 3. Due to the modular approach, the number of FIFO's, CASGEN's, and FB's added can be increased indefinitely to match any network bandwidth.

The resolution of the frame buffer can also be extended. For example, if each memory module is designed using 1 million bit VRAMs, each of which is configured as 512 rows by 512 columns by 4 bits each, then the 4×4 memory modules are configured as 2048 rows by 2048 columns by 4 bit-planes. This can be extended to match any system requirement. First, increasing bit-planes per pixel can be done by adding more VRAMs. For example, if a 30 bit R,G,B data format is used, then eight 1 Mbit VRAMs per memory module can be used (this configuration can provide up to 32 bit-planes). Although 2048×2048 resolution frame buffer is adequate for most applications, there are situations such as double buffering, real-time panning, or higher resolution monitors where even larger frame buffer configurations are needed.

Figure 10:
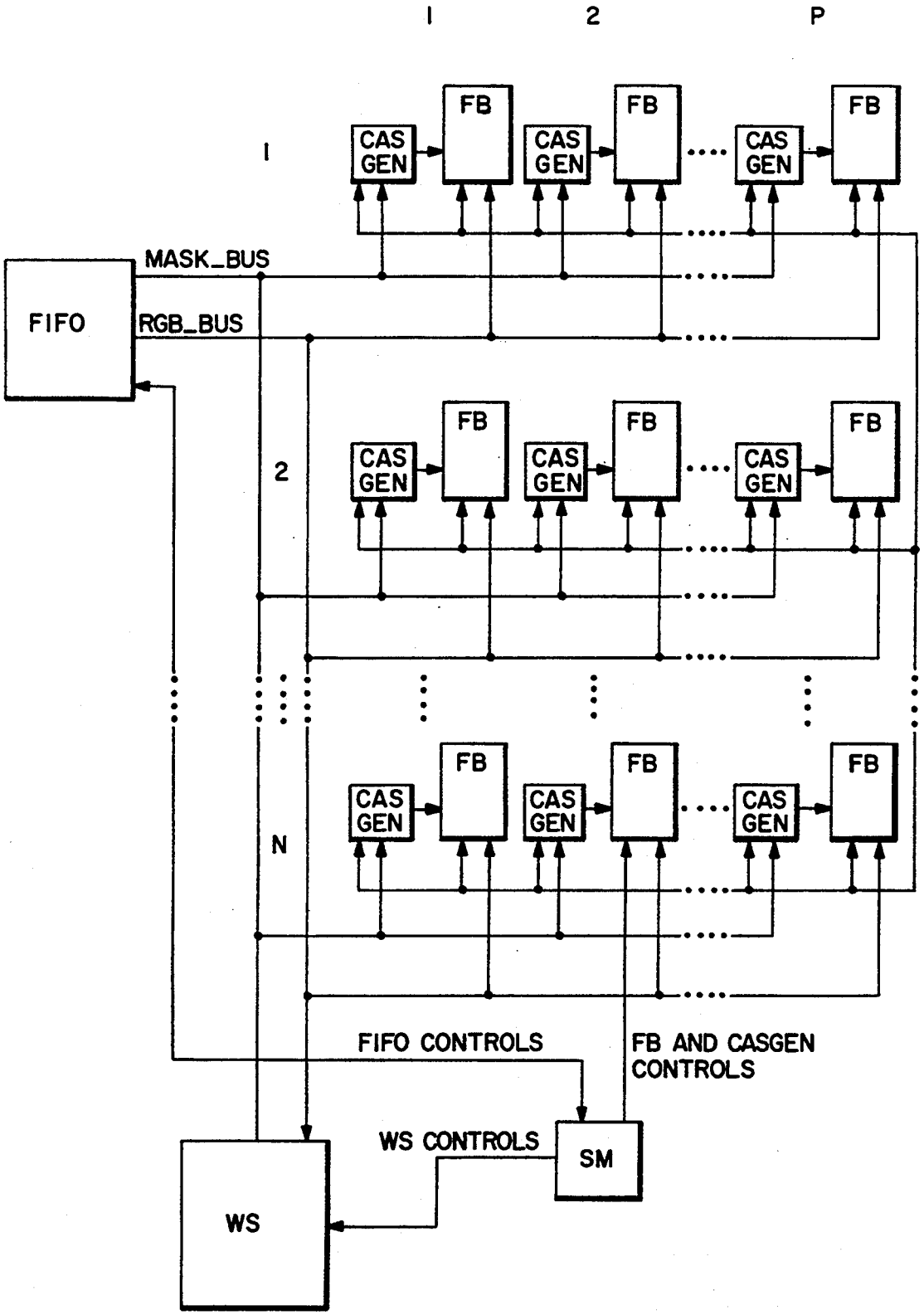
FIG. 10 is a block diagram of an embodiment of the invention enabling higher resolution frame buffer operation.

The invention may be extended indefinitely in both horizontal and vertical directions to accommodate any size frame buffer. If the frame buffer needs to be extended horizontally, then more 4×4 modules can be added horizontally as shown on FIG. 10, where there are P 4×4 memory modules horizontally which provide a total of 2048P horizontal pixels. If the frame buffer needs to be extended vertically, then more horizontal rows of P 4×4 modules can be added vertically, as shown, where there are N 4×4 memory modules vertically which provides a total of 2048N vertical pixels.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

We claim:

1. In a display system including storage means for receiving compressed pixel image data manifesting at least a pair of encoded colors and a bit MASK including n times m bit positions with assigned values that define which pixels in an n×m pixel subset of said pixel image receive one of said pair of encoded colors, said system further comprising:

a plurality of memory modules organized as an n×m array of memory modules, the pixels in a said pixel subset being stored in said plurality of memory modules in an interleaved fashion;

generator means for applying signals to cause data to be written in parallel into said plurality of memory modules;

register means for manifesting said encoded color data; and means for controlling said generator means to write said encoded color data into all pixel positions of said pixel subset designated for said color by said MASK bit positions, wherein said pair of encoded colors are written into said memory modules in a single memory access cycle in accordance with said n times m bit MASK bit positions, said control means comprising;

means for activating a first signal during an initial portion of said single memory access cycle to operate said generator means to write first encoded color data into all of said plurality of memory modules, if any, that are specified by first value manifestations of said n times m bit MASK bit positions, and for activating a second signal during a subsequent portion of said single memory access cycle to write second encoded color data into all remaining ones of said plurality of memory modules, if any, that are specified by second value manifestations of said n times m bit MASK bit positions, wherein the compressed pixel image data for an n×m pixel subset is decompressed during the single memory access cycle.

2. The display system of claim 1 wherein said first and second signals are activated so that portions thereof overlap during said single memory access cycle.

3. The display system of claim 1, wherein n and m are both equal to 4 such that said memory modules comprise a 4×4 array of modules, and wherein 4×4 pixel data subsets in said modules are interleaved so that each pixel in a said 4×4 pixel data subset resides in a different said module of said 4×4 array.

4. The display system of claim 3 wherein each said module is a video random access memory that employs concurrently applied RAS, and CAS* signals to accomplish data writes during a memory access cycle, and wherein said generator means is energized, during a single memory access system by said first signal to apply CAS* signals to pixel storage positions corresponding to MASK bit positions that manifest a first bit value, and to apply a second set of CAS* signals to pixel storage positions corresponding to MASK bit positions that manifest second bit values.

5. The display system of claim 4 wherein said register means manifests said first of said pair of encoded colors during a first portion of said memory cycle and a second of said pair of encoded colors during a second memory portion of said cycle, whereby said pair of colors are written to all said 4×4 pixel subset in said modules in said single memory access cycle.

6. In a display system including storage means for receiving compressed pixel image data manifesting at least a pair of encoded colors and a bit MASK including n times m bit positions with assigned values that define which pixels in an n×m pixel subset of said pixel image receive one of said pair of encoded colors, said system further comprising:

a plurality of memory modules, each module comprised of a set of submodules, a row of n pixels in a pixel subset being stored across a row of n submodules in a memory module in an interleaved fashion, additional series of n pixels in pixel subsets in said row being stored in interleaved fashion in submodules in succeeding memory modules, all said memory modules being connected in parallel;

CAS* generator means associated with each memory module for applying CAS* signals to enable data to be written into submodules within said associated memory module;

means for manifesting said encoded color data at an output thereof; and control means for causing said CAS* generator means to write said encoded color data into storage areas within said submodules storing said pixel subset, under control of said bit MASK bit position values, whereby a color value is written in parallel, across a plurality of said memory modules, wherein said control means operates said CAS* generator means, during an initial portion of a single memory access cycle, to generate from zero to n times m first CAS* signals in accordance with a first value of said n times m MASK bit position values to write first encoded color data into first selected storage areas of said submodules storing said pixel subset, and to generate, during a subsequent portion of the single memory access cycle, from zero to n times m second CAS* signals in accordance with a second value of said n times m MASK bit position values to write second encoded color data into second selected storage areas of said submodules storing said pixel subset, wherein the compressed pixel image data for an n×m pixel subset is decompressed during the single memory access cycle.

7. The display system as recited in claim 6 wherein all of said memory modules are connected in parallel to said output of said manifesting means.

8. The display system as recited in claim 7 further comprising:

one or more additional pluralities of said memory modules coupled to said output of said manifesting means, wherein all of said memory modules are arranged in columns and rows of memory modules, whereby said control means enables encoded color data to be written into interleaved pixel storage positions in said memory modules.

9. The display system as recited in claim 7 further comprising:

additional means for manifesting said encoded color data, all said means for manifesting outputting said encoded color data in parallel, each said manifesting means connected in parallel to a plurality of said memory modules, whereby said control means is operative to cause each said encoded color data to be written into said memory modules in an interleaved fashion and in parallel.

10. A display system comprising:

input means for coupling to a communication bus and including means for buffering display data received from said communication bus, said display data including, for individual ones of a plurality of n×m display pixel regions, compressed image data comprised of first color data and second color data, said compressed image data further including, for individual ones of the plurality of n×m display pixel regions, mask data having n times m bits individual ones of which specify whether said first or said second color data is to be provided for one of the display pixels within an associated one of the n×m display pixel regions;

a plurality of memory modules organized as an n×m array of memory modules for storing color data for an n×m display pixel region in an interleaved fashion;

register means having an input coupled to an output of said buffering means and an output coupled in common to a data input of each of said plurality of memory modules, said register means storing, for a particular one of the n×m display pixel regions, said first color data and said second color data;

memory module control means having n times m memory control outputs each of which is coupled to one of said n×m memory modules, an assertion of a particular one of said memory control outputs, during a memory access cycle, causing the associated one of said n×m memory modules to store data appearing at said data input;

further register means having an input coupled to said output of said buffering means and an output coupled to said memory module control means, said further register means storing, for a particular one of the n×m display pixel regions, said n times m bit mask data; and control means operating to generate, for buffered compressed image data for each of the n×m display pixel regions, control signals controlling the operation of said register means, said further register means, and said memory module control means, said control signals including signals for causing said memory module control means to assert, during a single memory access cycle, a first set comprised of from zero to n times m of said memory control outputs as a function of a first logic state of individual ones of said n times m bits of mask data, and to subsequently assert, during the single memory access cycle, a second set comprised of from zero to n times m of said memory control outputs as a function of a second logic state of individual ones of said n times m bits of mask data, wherein compressed image data for an n×m display pixel region is decompressed in a single memory access cycle.

11. A display system as set forth in claim 10 wherein said memory control outputs are n times m CAS* signals, and wherein said second set are asserted while said first set are asserted.

12. A display system as set forth in claim 10 wherein said buffering means includes a first in/first out (FIFO) buffer having an output status signal for indicating that display data is stored within said FIFO, and wherein control means is responsive to said output status signal for generating said control signals.

13. A display system as set forth in claim 10 and further comprising a source of image pixel data, said source having an output coupled to said output of said register means for supplying image pixel data for storage within said memory module under control of control signals generated by said control means.

14. A display system as set forth in claim 10 wherein the display data is received at a rate of T pixels per second, wherein P is a number of pixels that are decompressed per second for an n×m array of memory modules, wherein N is a number of interleaved n×m memory module arrays, and wherein N is made equal to a number that satisfies the relationship T is equal to or less than N times P.

* * * * *

UNITED STATES PATENT AND TRADEMARK OFFICE

CERTIFICATE OF CORRECTION

PATENT NO. : 5,420,608

DATED : May 30, 1995

INVENTOR(S) : Choi et al.

It is certified that error appears in the above-identified patent and that said Letters Patent is hereby corrected as shown below:

In column 11, line 27, the term "RAS" should be replaced with --RAS*--.

In column 11, line 30, the word "system" should be replaced with the word —cycle,—.

Signed and Sealed this

Fifteenth Day of August, 1995

Bruce Lehman

BRUCE LEHMAN

*Commissioner of Patents and Trademarks*

*Attest:*

*Attesting Officer*